US008574429B2

(12) United States Patent
Zhang et al.

(10) Patent No.: US 8,574,429 B2
(45) Date of Patent: Nov. 5, 2013

(54) SULFONE REMOVAL FROM AN OXIDIZED HYDROCARBON FUEL

(75) Inventors: Tiejun Zhang, Bellaire, TX (US); Nachiketa Anand, Katy, TX (US); Theodore Sidney Hoover, Oklahoma City, OK (US)

(73) Assignee: Merichem Company, Houston, TX (US)

( * ) Notice: Subject to any disclaimer, the term of this patent is extended or adjusted under 35 U.S.C. 154(b) by 284 days.

(21) Appl. No.: 12/872,055

(22) Filed: Aug. 31, 2010

(65) Prior Publication Data

US 2012/0048779 A1 Mar. 1, 2012

(51) Int. Cl.
*C10G 19/00* (2006.01)

(52) U.S. Cl.
USPC ..... 208/230; 208/208 R; 208/226; 208/177

(58) Field of Classification Search
USPC ..... 208/222, 226–250
See application file for complete search history.

(56) References Cited

U.S. PATENT DOCUMENTS 3,505,210 A * 4/1970 Wallace et al. ..... 208/228
3,758,404 A 9/1973 Clonts
3,977,829 A 8/1976 Clonts
3,992,156 A 11/1976 Clonts
4,666,689 A 5/1987 Maple et al.
4,675,100 A 6/1987 Maple et al.
4,753,722 A 6/1988 Le et al.
4,906,354 A * 3/1990 Barry et al. ..... 208/189
2006/0231490 A1 * 10/2006 Manna et al. ..... 210/634
2009/0065399 A1 * 3/2009 Kocal et al. ..... 208/229

OTHER PUBLICATIONS http://www.eere.energy.gov/basics/vehicles/ultra_low_sulfer_diesel.html.*
http;//www.eere.energy.gov/basics/vehicles/ultra_low_sulfer_diesel.html (2010) , 1.*
International Search Report and Written Opinion for PCT/US2011/049821, completed Dec. 14, 2011.
International Preliminary Report on Patentability for Int. App. No. PCT/US2011/049821, mailed Mar. 14, 2013.

* cited by examiner

*Primary Examiner* — Randy Boyer
*Assistant Examiner* — Juan Valencia
(74) *Attorney, Agent, or Firm* — McDonnell Boehnen Hulbert & Berghoff LLP

(57) ABSTRACT

A one-step process for desulfurizing an oxidized sulfone-containing fuel stream, such as a diesel stream, is disclosed where mass transfer and conversion of sulfone occurs simultaneously such that the sulfur atom in sulfone molecule is removed as sulfite to provide a low-sulfur diesel stream. The diesel stream for treatment is obtained as a result of the oxidation of a thiophene-rich diesel stream with an oxidant to provide a sulfone-containing diesel stream. The one-step process uses a single vessel having a shroud of vertical hanging fibers to affect the mass transfer of sulfones in diesel into contacting with an aqueous solution of alkali metal hydroxide where it is converted to sulfite and biphenyls. The sulfite-rich aqueous solution and low sulfur diesel are then separately removed from the vessel.

9 Claims, 1 Drawing Sheet

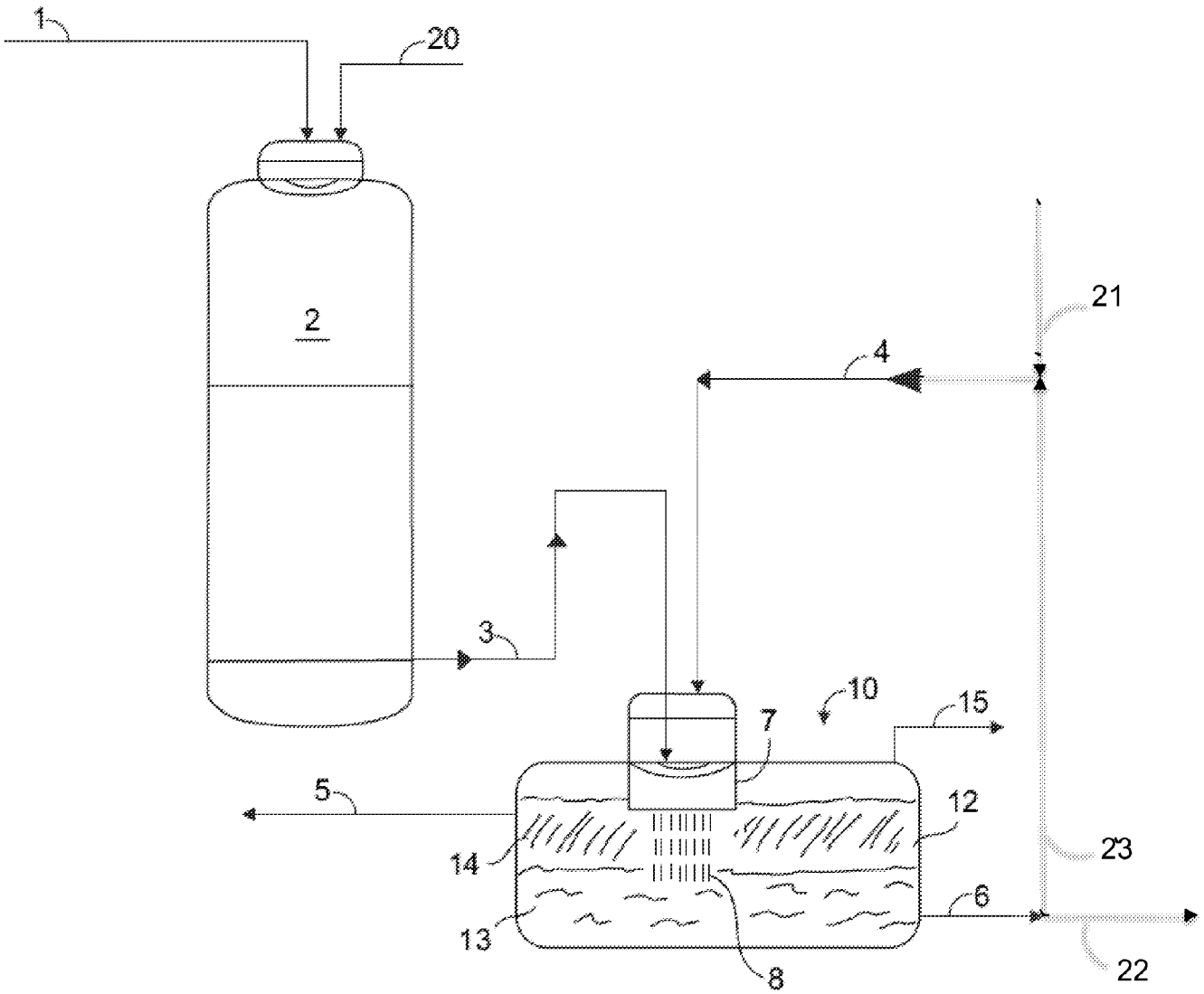
1
20
2
3
4
5
21
23
22
15
12
6
10
7
8
14
13

SULFONE REMOVAL FROM AN OXIDIZED HYDROCARBON FUEL

BACKGROUND

1. Technical Field

A single step process is disclosed to treat a liquid hydrocarbon stream containing sulfones that uses a bundle of vertical hanging fibers inside a shroud to simultaneously carry out the mass transfer and the reaction with alkali metal hydroxide. The sulfur in the sulfone molecules is removed as inorganic sulfite while the rest of the sulfone molecular structure is returned to hydrocarbon. An alkali metal hydroxide solution, such as sodium hydroxide and potassium hydroxide, and a sulfone-containing hydrocarbon stream enter at the top of the shroud and flow down the fibers where mass transfer and conversion of sulfone occurs. A low sulfur hydrocarbon product stream and a sulfite-rich aqueous stream are separately removed from the process. This single step process requires no hydrogen and can be carried out in one vessel thus minimizing space requirements and costs.

2. Description of the Related Art

The presence of sulfur in petroleum fuels is a major environmental problem and regulatory compliance has increasingly forced refiners to produce ultra low sulfur fuels. This is because the sulfur present in fuels is converted when combusted into various sulfur oxides that are then transformed into acids, thus contributing to the formation of hazardous acid rain. These acids also reduce the efficiency and life of catalytic converters in automobiles. Furthermore, sulfur compounds are thought to ultimately increase the particulate content of combustion exhaust gas.

Reducing the sulfur content in hydrocarbon streams, especially in hydrocarbon fuel streams, therefore has become a major objective of environmental legislation worldwide, with major countries imposing very strict limits on the amount of sulfur in diesel fuels. To reduce the sulfur in hydrocarbon streams, refiners typically use catalytic hydrodesulfurizing ("HDS", a.k.a. "hydrotreating") processes. In HDS, a hydrocarbon stream that is derived from a petroleum distillation is treated in a reactor that operates at high temperatures and high pressures where sulfur compounds, such as thiophenes, react with hydrogen in the presence of a catalyst (e.g., cobalt and molybdenum sulfides or nickel and molybdenum sulfides supported on alumina). Because of the extreme operating conditions and the consumption of expensive hydrogen, these HDS methods can be costly both in capital investment and operating costs.

Moreover, sometimes conventional HDS or hydrotreating are insufficient to produce a hydrocarbon product in compliance with the current strict sulfur level targets. This is due to the presence of sterically hindered sulfur compounds such as substituted dibenzothiophenes that act as refractory compounds in HDS environments. For example, it is particularly difficult to eliminate traces of sulfur using such catalytic HDS processes when the sulfur is contained in molecules such as dibenzothiophene with alkyl substituents in position 4, or 4 and 6. These species are more prevalent in heavier stocks such as diesel fuel and fuel oil. Attempts to completely convert these species have resulted in increased equipment costs, more frequent catalyst replacements, and degradation of product quality due to side reactions.

One emerging alternative to or an add-on for HDS process is oxidative desulfurization (ODS). In an ODS process, refractory sulfur compounds such as substituted dibenzothiophenes in a hydrocarbon fuel stream are oxidized, under mild reaction conditions, into sulfone compounds in the presence of an oxidizing agent and a catalyst. The sulfone compounds are subsequently separated from the hydrocarbon stream. Hydrogen is not needed in ODS processes.

The ODS processes reported in literature vary and include: contact with a mixture of hydrogen peroxide and a carboxylic acid to produce sulfones, which are then degraded by thermal treatment to volatile sulfur compounds; oxidation in the presence of a dilute acid, with the sulfones being extracted using a caustic solution; a combination of the oxidation and thermal treatment steps with hydrodesulfurization; a two-step oxidation and extraction method extracting with a paraffinic hydrocarbon comprising a 3-6 carbon alkane; and various catalytic oxidation processes.

Specifically, techniques for removal of sulfones from oxidized hydrocarbon include extraction, distillation, and adsorption. These separation processes rely on the altered chemical properties such as solubility, volatility, and reactivity of the sulfone compounds when contrasted with the original sulfur compounds.

Liquid-liquid extraction is the conventional option for removing sulfones from oxidized hydrocarbon. Adsorption by solid adsorbent is another option. Both the liquid-liquid and solid-liquid processes result in loss of the entire sulfone molecules to the extracting solvent or the adsorbent. In case of liquid-liquid extraction, the sulfone must be separated from the solvent, usually by distillation, prior to recycling the solvent for further extraction. For solid-liquid adsorption processes, the adsorbent must be disposed of when spent or frequently regenerated due to low adsorption capacity currently achievable. The high operating costs of these multi-step processes have necessitated the development of an alternate technology.

Furthermore, when the sulfones are separated as a liquid, it must be either destroyed in a refinery operation unit such as Fluid Catalytic Cracker and Delayed Coker or find another outlet. Unfortunately, market demands for sulfone in surfactant manufacturing and other industries are insufficient to handle this additional supply.

Therefore, there is a need for a process for removing refractory sulfur from hydrocarbon fuel streams that are more efficient and cost-effective than hydrotreating or HDS. There is also a further need for a process for removing the sulfur while without removing the whole sulfone molecular structure from hydrocarbon fuel stream that has undergone an oxidation process, or so-called "oxidized hydrocarbon fuel". Both needs are met in our invention by treating an oxidized hydrocarbon fuel stream with an aqueous solution of alkali metal hydroxide to cleave the sulfur atom from the sulfone molecules and by carrying out the cleavage chemistry in a specialty contactor comprising a vertical hanging high surface area fibers, e.g., Merichem Company's Fiber Film® contactor, that is highly efficient for mass transfer between two immiscible phases.

SUMMARY

A single-step method for extracting and converting sulfones present in a hydrocarbon fuel stream, such as a diesel stream, that has been subjected to an oxidative desulfurization process is disclosed. The initial fuel stream that contains a substantial amount of sulfur in the form of one or more thiophenic compounds or thiophenes, is subjected to an oxidative desulfurization that causes the thiophenes to be oxidized to sulfones.

Although conventional multi-step processes exist such as distillation, extraction and adsorption for separating the sulfones from the hydrocarbon fuel phase, they all suffer a common drawback in that the entire sulfone molecule rather than the sulfur atom alone is removed from the hydrocarbon. This drawback not only generates a stream requiring subsequent special handling but also result in yield loss, both making those processes more costly.

The process of this invention is based on the known chemistry of reacting sulfones with alkali metal hydroxide, which cleaves the sulfur atom from the sulfone molecular structure. The sulfur is removed as sulfite salts, while the rest of sulfone molecular structure becomes a sulfur-free molecule such as biphenyls that remains in hydrocarbon phase.

The difficulty of carrying out the above cleavage chemistry lies in the fact that sulfones are present in the hydrocarbon phase while alkali metal hydroxide is not soluble in hydrocarbon. Therefore, when the reaction is attempted in conventional reactors such as stirred tank reactors, intensive mixing must be provided yet the reaction remains extremely slow even at substantially elevated temperatures, thus requiring a large reactor volume to achieve an acceptable of conversion and making the process more expensive.

Therefore, in one embodiment of this invention a specialty contactor comprising a collection of vertical hanging fibers is used to provide intimate contacting between a hydrocarbon phase containing sulfones and an aqueous phase containing at least one alkali metal hydroxide. One such example of this specialty contactor is the Merichem Company's Fiber Film® contactor that contains a bundle of vertical handling fibers which attract the aqueous phase to form a thin film on the surface of and around each fiber. A collection of such aqueous films provide an enormous amount of mass transfer surface with which the hydrocarbon phase readily comes to contact.

Another embodiment of this invention is provided that the specialty contactor employed for this cleavage reaction is enhanced with capability to operate at substantially elevated temperatures and pressures. All known commercial Fiber Film® contactors are limited to operating temperatures below 100° C. and operating pressures below 35 atm.

A further embodiment of this invention is that a single-step process in a single vessel based on vertical hanging fiber contactor technology is used to simultaneously accomplish the mass transfer of sulfones into contacting the aqueous stream of alkali metal hydroxide and the reaction of sulfones with alkali metal hydroxide to cleave sulfur atoms from sulfones molecules, thus producing a sulfur-free or low sulfur fuel and a sulfite-rich aqueous stream that may or may not require further treatment.

Unlike conventional processes, the process of this invention needs no solvents or sorbents to first extract the sulfones from the fuel, nor does it generate a sulfone or sulfone-rich oil stream that requires further separate treatment regarding sulfones. In contrast to our invention, in one prior art process, the oxidized diesel containing sulfones is first contacted with a solvent or a sorbent to separate the sulfones from the diesel, which generates a sulfone-rich oil that is then treated in a separate unit where the sulfone-rich oil alone is subjected to another process using a caustic stream that converts sulfones into biphenyls and forms sulfites.

Our process eliminates the multiple steps required in prior art processes by using a single piece of equipment containing a bundle of vertical hanging fibers that allows the sulfone-containing hydrocarbon fuel and a separate aqueous stream of alkali metal hydroxide to flow down the individual fibers where the high surface area of the fibers causes the sulfones to rapidly transfer into contacting the alkali metal hydroxide where they are converted to corresponding unsubstituted and substituted biphenyls and alkali metal sulfite (such as $K_2SO_3$). The biphenyls will transfer back to the hydrocarbon fuel phase and will not be part of the aqueous phase. At the bottom of the specialty contactor that comprises a single vessel is a collection section where a higher density aqueous phase is formed at the bottom of the vessel and a lower density phase of hydrocarbon fuel is formed at the upper section of the vessel. Each phase is continuously removed as separate streams. The aqueous bottom phase is recycled to treat more hydrocarbon while a small stream of the aqueous phase is withdrawn as purge that is either disposed of, treated to remove the sulfur compounds, or used elsewhere.

The shroud of vertical hanging fibers used in our invention has found applications in other refinery operations, most typically, as liquid-liquid contactors as described in U.S. Pat. Nos. 3,758,404; 3,977,829 and 3,992,156, all of which are incorporated herein by reference. As stated, Merichem Company sells one commercial example of such a contactor under the trade name Fiber Film®. Although it is well known to use Fiber Film® technology in liquid-liquid contacting applications in which two immiscible liquids contact each other for enhanced mass transfer of certain compounds, the art has not recognized that Fiber Film® technology is capable of treating hydrocarbon fuels, such as diesel, that have been treated in an oxidation process where sulfones are formed. This is despite the fact that the Fiber Film® technology has been commercialized for 35 plus years. Only recently, because of the increased need for low sulfur fuels due to regulatory changes, has there been demand to develop efficient and improved processes to eliminate or minimize refractory sulfur compounds.

One aspect of our invention involves the introduction into the bundle of fibers at the top both an aqueous stream containing at least one alkali metal hydroxide and an oxidized diesel fuel stream containing sulfones. The two streams are evenly distributed through a distributing system at the top of the shroud and co-flow downward along the many individual fibers. Not to be bound by any working theory, a thin film of aqueous phase is formed around each fiber to provide an exceptionally high total amount of interfacial mass transfer surface area with which the sulfones in the hydrocarbon first comes to contact. At or near the interface, the reaction between sulfone and alkali metal hydroxide occurs that causes the conversion of sulfones to biphenyls and sulfites with the sulfites remaining in the aqueous solution and biphenyls reverting to the hydrocarbon phase. Eventually, at the collection section of the single vessel contactor the two immiscible liquids quickly separate from each other and form two distinct layers in a collection zone at the bottom of single vessel. The two distinct liquid layers, a bottom layer comprising the higher density aqueous liquid and an upper layer comprising the lower density sulfur free diesel liquid, allow for each to be withdrawn separately from the collection section.

Although an oxidized diesel fuel containing sulfones is the preferred feed treated by our single-step process, other oxidized fuels, such as FCC gasoline, naphtha, Jet fuel, kerosene, heavy naphtha, middle distillate, light cycle oil (LCO), heavy oils, crude oil, hydrogenated vacuum gas oil (VGO), non-hydrogenated VGO, and synthetic crude from oil sand and residue oil, can be treated as well. Likewise, the preferred aqueous solution of our invention comprises potassium hydroxide and sodium hydroxide, although we believe any type of the following solutions can be used including solutions comprising LiOH, NaOH, KOH, and RbOH as well as $Ca(OH)_2$, $Na_2CO_3$, and ammonia. Preferably, the aqueous solution comprises potassium hydroxide and sodium hydroxide having concentration of from about 1% to about 50 wt. %, more preferably from about 3% to about 25 wt. %, still more preferably from about 5% to about 20%, by weight alkali metal hydroxide.

Accordingly, in one aspect, our invention covers a single step process in a single vessel for treating a sulfone containing hydrocarbon fuel stream comprising combining a sulfone containing hydrocarbon stream with an aqueous solution of alkali metal hydroxide stream at the top of a shroud of vertical hanging fibers and allowing the sulfones in the hydrocarbon to rapidly transport to the interface with the aqueous stream and to be simultaneously converted to sulfites to form a sulfite-rich aqueous solution and a low sulfur hydrocarbon, where a stream of low sulfur hydrocarbon fuel and a stream of sulfite-rich aqueous solution are separately removed from the collection section of the vessel. Although biphenyls are formed from the reaction of the sulfones with the alkali metal hydroxide, there is no need to have a separate process to recover these biphenyls because our single-step process allows the biphenyls to transfer back into the hydrocarbon fuel phase.

The sulfones found in the oxidized fuel stream that is fed to our process may comprise dibenzothiophene dioxide and substituted dibenzothiophene dioxide. The biphenyls may comprise unsubstituted biphenyls and various substituted biphenyls. Importantly, in our process the sulfones are not required to be removed from the oxidized fuel prior to treatment as required in known multi-step prior art processes. The oxidized fuel stream and the aqueous stream of alkali metal hydroxide are contacted at the top of the shroud of vertical hanging fibers preferably at a temperature below about 350° C. and at a pressure below about 170 atm, preferably below 300° C. and 100 atm, and most preferably below 150° C. and 15 atm.

These and other objects will become more apparent from the detail description of the preferred embodiment contained below.

BRIEF DESCRIPTION OF THE FIGURES

FIG. 1 schematically illustrates one possible embodiment of the single-step process of our invention using a bundle of vertical hanging fibers to remove and convert sulfones from an oxidized fuel stream.

DETAILED DESCRIPTION

As stated, our invention concerns a novel process for the removal of sulfur from sulfones that are present in an oxidized fuel stream, such as diesel fuel, by utilizing a bundle of vertical hanging, high surface area, fibers, preferably Merichem's Fiber Film® technology, and an aqueous solution of alkali metal hydroxide. As opposed to multi-step prior art processes, our single-step process eliminates the need for solvent extraction or adsorption steps, gravity settlers or forced separation technology, such as centrifuges, recycle streams, etc. This novel use of vertical hanging fiber technology drastically reduces equipment capital costs, operating residence times, and physical space requirements because only a single vessel is needed to perform the one-step process of our invention.

FIG. 1 illustrates one embodiment 10 of our invention where a diesel fuel, containing a substantial content of sulfur compounds, is first fed via line 1 to an oxidizer 2 along with an oxidant 20, where in the presence of a catalyst and possibly an oil-soluble organic peroxide oxidant, the sulfur compounds are converted to, among other components, sulfones (or sulfoxides). As stated, a refined diesel must be subjected to desulfurization process in order to meet current and future environmental standards. In oxidative desulfurization (ODS), various thiophenes, of both the unsubstituted and substituted type are oxidized to sulfones, of both the substituted and unsubstituted types. A preferred oxidant for treating the fuel or diesel stream is hydrogen peroxide. However, various oxidizing agents may be used including alkylhydroperoxides, other peroxides, percarboxylic acids, oxygen and air as well as combinations thereof. An oxidant that is soluble in hydrocarbon phase is preferred over aqueous hydrogen peroxide and other non-soluble oxidants.

The oxidation reaction typically occurs at a temperature and pressure of from about 0 to about 150° C. and from about 0 to about 15 atm, respectively. The specific design of the oxidizer is not critical to our invention 10 and any number of oxidizer designs may be used, such as plug a flow reactor, a continuous stirred tank reactor, an air bubble oxidizer, non-catalytic solid packing, and solid catalyst technology. These as well as other oxidizer configurations are well known to those skilled in the art. The reaction product, or the so-called oxidized diesel fuel that now contains sulfones, is removed from oxidizer 2 via line 3 and fed to the single-step process 10 of our invention.

The sulfone-containing diesel fuel is fed to the top of shroud 7 containing vertical hanging fibers 8. Also fed to the top of shroud 7 is line 4 containing an aqueous solution of alkali metal hydroxide where it flows co-currently with the sulfone-containing diesel fuel down the vertical hanging fibers. The aqueous solution of alkali metal hydroxide used in our invention can be any type known to the art of hydrocarbon treating, including alkali metal hydroxide solutions comprising LiOH, NaOH, KOH, and RbOH as well as other solutions such as $Ca(OH)_2$, $Na_2CO_3$, and ammonia, or mixtures thereof. The aqueous solution of alkali metal hydroxide may be a recycled stream 23, a fresh stream 21, or a mixture of thereof as shown in FIG. 1. Preferably, the aqueous solution comprises aqueous potassium hydroxide solutions and aqueous sodium hydroxide solutions having concentration of from about 1% to about 50%, more preferably from about 3% to about 25%, still more preferably from about 5% to about 20%, by weight alkali metal hydroxide.

The single vessel 10 can be any device that uses a column of tightly packed fibers and that provides large surface area for mass transfer of the sulfones into the interface with aqueous solution. As mentioned, such Fiber Film® technology has been used in the past in liquid-liquid and gas-liquid contactors to facilitate mass transfer of chemical compounds from one liquid to another liquid, but to our knowledge has never been employed to treat an oxidized fuel stream containing sulfones. The design of these Fiber Film® liquid-liquid contactors has been described in various references, for example, in U.S. Pat. Nos. 3,758,404, 3,992,156, 4,666,689, 4,675,100 and 4,753,722, all of which are incorporated herein by reference for all purposes. We believe our invention is the first to utilize vertical hanging fibers in a single-step sulfone removal process. Conventional wisdom suggests that a long residence time is necessary in a conventional reactor even with severe conditions but the hanging fiber technology actually is contrary to this conventional wisdom by providing a very large interfacial surface for mass transfer well above the temperature and pressure ranges normally considered or used for such treating applications.

The vertical hanging fibers 8 in vessel 10 are selected from a group consisting of, but not limited to, metal fibers, glass fibers, polymer fibers, graphite fibers and carbon fibers to meet two criteria: (1) the fiber material must be wettable by one of the two immiscible liquids, preferably the aqueous phase; and (2) the fibers must be of a material that will not contaminate the process or be destroyed by it, such as by corrosion.

During the operation of vessel 10 two layers form in the bottom section 12; a lower layer 13 comprising aqueous solution and an upper layer 14 comprising separated sulfur free or low sulfur diesel fuel. The shroud and the fiber bundle extend out partly from the confines of shroud 7, with the positioning of the downstream end of the fiber bundle is within lower layer 13. The cleaned oxidized diesel fuel, i.e., substantially sulfur-free, in upper layer 14 is removed from vessel 10 via line 5 and sent to storage or for further processing. By substantially sulfur free we mean the diesel fuel has a sulfur level of <50 ppm total sulfur, preferably <20 ppm total sulfur and more preferably <10 ppm total sulfur. The aqueous solution is removed as a separate stream via line 6, with a majority recycled 23 and a small stream of purge 22 sent for disposal or further processing.

Vessel 10 is operated at a temperature up to about 350° C. and at a pressure of up to about 170 atm. Because of these high temperatures, high pressures and the high corrosivity of alkali metal hydroxide solution, it is preferred that the vessel is constructed of a specialty metal or metals, such as nickel alloys containing at least 60 wt % nickel. The concentration of alkali metal hydroxide in line 4 can range from about 1 to about 50 wt %. The residence time within process 10 is selected to achieve maximum removal and conversion of sulfones from the oxidized diesel fuel stream in line 3, with the target concentration of all sulfur compounds being 10 ppm or less in treated stream 5. Substantially milder reaction conditions may be used in the presence of a catalyst that catalyzes the cleavage chemistry of removing sulfur atom from sulfone molecule structure.

The foregoing description of the specific embodiments will so fully reveal the general nature of the invention that others can, by applying current knowledge, readily modify and/or adapt for various application such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

The means, materials, and steps for carrying out various disclosed functions may take a variety of alternative forms without departing from the invention. Thus, the expressions "means to . . . " and "means for . . . ", or any method step language as may be found in the specification above or the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same function can be used; and it is intended that such expressions be given their broadest interpretation within the terms of the following claims.

The invention claimed is:

1. A single step process for treating sulfone containing hydrocarbons in a single vessel comprising contacting a sulfone containing hydrocarbon stream with an aqueous solution of alkali metal hydroxide inside a shroud of vertical hanging fibers at a temperature in the range of from 150° C. to 350° C., allowing the alkali metal hydroxide to react with the sulfones cleaving sulfur atoms from the sulfones to form a sulfite rich aqueous phase and a substantially sulfur free hydrocarbon phase, wherein the single vessel comprises a nickel alloy and where a stream of the substantially sulfur free hydrocarbon phase and a stream of sulfite rich aqueous solution are separately removed.

2. The process of claim 1 where the sulfones comprise dibenzothiophene sulfones and substituted dibenzothiophene sulfones.

3. The process of claim 1 where the aqueous solution of alkali metal hydroxide comprises from about 1% to about 50%, by weight potassium hydroxide.

4. The process of claim 1 where the aqueous solution of alkali metal hydroxide comprises from about 1% to about 50%, by weight sodium hydroxide.

5. The process of claim 1 where wherein the aqueous solution of alkali metal hydroxide is obtained from a recycled stream.

6. The process of claim 1 wherein the combining of the sulfone containing hydrocarbon with the aqueous solution of alkali metal hydroxide is carried out at a at a pressure of from about 15 atm to about 170 atm in a single vessel, a portion of which is constructed of a specialty metal comprising at least 60 wt. % nickel.

7. The process of claim 6 where the single vessel has a lower liquid collection section where substantially sulfur free hydrocarbons form an upper liquid phase and a sulfite containing aqueous solution forms a lower liquid phase.

8. The process of claim 7 where a portion of the upper phase is continuously removed from the collection section of the vessel and a portion of the lower liquid phase is separately removed from the collection section.

9. The process of claim 1 where the substantially sulfur free hydrocarbon comprises less than 10 ppm total sulfur.

* * * * *